US012203367B2

(12) United States Patent
Boyland

(10) Patent No.: US 12,203,367 B2
(45) Date of Patent: Jan. 21, 2025

(54) UNDERGROUND DEVELOPMENT DRILL RETURN SYSTEM

(71) Applicant: BCI MINING TECHNOLOGY PTY LTD, Busselton (AU)

(72) Inventor: Antony Albert Philip Boyland, Busselton (AU)

(73) Assignee: BCI MINING TECHNOLOGY PTY PTD, Busselton (AU)

( * ) Notice: Subject to any disclaimer, the term of this patent is extended or adjusted under 35 U.S.C. 154(b) by 277 days.

(21) Appl. No.: 17/770,915

(22) PCT Filed: Oct. 5, 2020

(86) PCT No.: PCT/AU2020/051070
§ 371 (c)(1),
(2) Date: Apr. 21, 2022

(87) PCT Pub. No.: WO2021/077155
PCT Pub. Date: Apr. 29, 2021

(65) Prior Publication Data

US 2022/0397003 A1 Dec. 15, 2022

(30) Foreign Application Priority Data

Oct. 24, 2019 (AU) ..... 2019904008

(51) Int. Cl.
*E21B 7/02* (2006.01)

(52) U.S. Cl.
CPC ..... *E21B 7/025* (2013.01); *E21B 7/022* (2013.01)

(58) Field of Classification Search
CPC ..... E21B 7/022; E21B 7/025
See application file for complete search history.

(56) References Cited

U.S. PATENT DOCUMENTS 3,204,706 A 9/1965 Jonsson
3,307,637 A 3/1967 Jonsson
(Continued)

FOREIGN PATENT DOCUMENTS

EP 1601854 B1 8/2006
WO 2014/187473 A1 11/2014
(Continued)

OTHER PUBLICATIONS

International Search Report for International Application No. PCT/AU2020//051070, mailed Nov. 20, 2020, 5 pages.
(Continued)

*Primary Examiner* — Kristyn A Hall
(74) *Attorney, Agent, or Firm* — TraskBritt

(57) ABSTRACT

Provided is an underground development drill return system comprising a front limit sensor and front sensor actuator, each configured for operative mounting at opposite ends of a forward drill feeder length of a drilling arm of the drill. System also includes a rear limit sensor and rear sensor actuator, each configured for operative mounting at opposite ends of a return drill feeder length of the drilling arm. Each limit sensor comprises a proximity sensor with a wireless transmitter for transmitting a limit signal upon activation of the sensor, and each sensor actuator comprises an actuator for actuating the respective sensor when brought into proximity thereof.

15 Claims, 4 Drawing Sheets

(56) References Cited

U.S. PATENT DOCUMENTS

| | | | | |
|---|---|---|---|---|
| 4,501,199 | A * | 2/1985 | Mashimo | E21B 7/022 299/13 |
| 5,139,097 | A | 8/1992 | Rajala | |
| 2012/0056751 | A1* | 3/2012 | Field | E21B 44/00 340/854.6 |
| 2021/0222542 | A1* | 7/2021 | Moberg | E21B 7/022 |

FOREIGN PATENT DOCUMENTS

| | | | |
|---|---|---|---|
| WO | 2016/202369 | A1 | 12/2016 |
| WO | 2017/217905 | A1 | 12/2017 |

OTHER PUBLICATIONS

International Written Opinion for International Application No. PCT/AU2020//051070, mailed Nov. 20, 2020, 4 pages.

* cited by examiner

UNDERGROUND DEVELOPMENT DRILL RETURN SYSTEM

CROSS-REFERENCE TO RELATED APPLICATIONS

This application is a national phase entry under 35 U.S.C. § 371 of International Patent Application PCT/AU2020/051070, filed Oct. 5, 2020, designating the United States of America and published as International Patent Publication WO 2021/077155 A1 on Apr. 29, 2021, which claims the benefit under Article 8 of the Patent Cooperation Treaty to Australian Patent Application Serial No. 2019904008, filed Oct. 24, 2019.

TECHNICAL FIELD

This disclosure relates broadly to the field of underground development drills or drill jumbos and, more specifically, to an underground development drill return system and an associated underground development drill.

BACKGROUND

The following discussion of the background art is intended to facilitate an understanding of the present disclosure only. The discussion is not an acknowledgement or admission that any of the material referred to is or was part of the common general knowledge as at the priority date of the application.

Underground development drills or drilling jumbos are well-known in the art of underground mining and such a jumbo is generally a rock drilling machine for applications ranging from face drilling for small-scale mine development to large-scale tunnelling. These jumbos usually consist of at least one rock drill mounted on a feed system, which is supported by a boom. Many jumbos have more than one drill mounted on separate booms.

In order to ensure several drills can be operated by one operator, automation exists where mechanisms are available to stop a drill when a hole is completed and to return the drill to its original position, completely automatically. All that an operator has to do is to reposition the boom with drill for its next hole and start the drilling process.

The action of drilling a hole typically requires the operator to engage certain controls, which, in turn, operates the rock drill. Once the hole is completed the rock drill then needs to be returned to the start point, therefore removing the drilling steel out of the hole. This process is called fast feed return and can be done manually with the operator controls.

Additionally, an automatic return system is typically standard option on most development drills. When the operator has this function switched on, it is a way of automatically returning the rock drill to the start point without any operator input. Conventional drills use hydraulic systems to complete this task. These hydraulic systems use a series of hydraulic impulse cylinders and actuators that send a hydraulic signal back up to a hydraulic control valve, which starts the return sequence.

However, these hydraulic return systems suffer shortcomings, such as the required hydraulic hoses are difficult to protect and easily broken operating in hazardous environments, and these hydraulic systems inherently lead to unnecessary wear on tear on machine components due to sudden and jerky movements.

This disclosure was conceived with these shortcomings in mind in an attempt to propose possible solutions, at least in part, in amelioration of these shortcomings in the art.

BRIEF SUMMARY

According to an aspect of the disclosure, there is provided an underground development drill return system comprising:

- a front limit sensor and front sensor actuator each configured for operative mounting at opposite ends of a forward drill feeder length of a drilling arm of the drill; and
- a rear limit sensor and rear sensor actuator each configured for operative mounting at opposite ends of a return drill feeder length of the drilling arm;

wherein each limit sensor comprises a proximity sensor with a wireless transmitter for transmitting a limit signal upon activation of the sensor; and wherein each sensor actuator is configured for actuating the respective proximity sensor when brought into proximity with the sensor.

The skilled addressee will appreciate that a drill feeder of an underground development drill typically comprises a drilling arm slidably arranged on an arm support that is held stationary on a drill boom so that the drilling arm slides forward when drilling and rearward when a drill bit is removed from a drilled hole. As such, the respective forward and rearward drill feeder lengths of the drilling arm are generally determined by a distance separation between the front limit sensor and front sensor actuator and rear limit sensor and rear sensor actuator, respectively. Typically, the forward and return drill feeder lengths are the same.

In an embodiment, a limit sensor and/or actuator includes an adjustable mount for mounting the sensor and/or actuator to the drilling arm so that the forward and/or return drill feeder lengths are adjustable.

In an embodiment, the limit sensor and/or actuator is adjustable so that the proximity of a sensor and actuator that actuates the sensor is adjustable.

In an embodiment, the limit sensor and/or actuator is configured to provide graded proximity activation, wherein the transmitted limit signal is indicative of at least two grades of proximity.

Typically, the proximity sensor comprises a magnetic Reed switch and the sensor actuator comprises a magnetic actuator.

The skilled addressee is to appreciate that a proximity sensor often emits, or is sensitive to, an electromagnetic field or a beam of electromagnetic radiation, e.g., infrared, and is responsive to changes in such a field. Examples of proximity sensors may include a capacitive proximity sensor, a photoelectric sensor, an inductive proximity sensor, or the like.

In an embodiment, the system includes a wireless receiver for receiving the limit signal and configured to interface with an existing control system of the drill, receipt of the limit signal causing the control system to feed or return the drilling arm automatically.

Typically, a limit sensor and/or actuator is encased in a ruggedized housing to prevent damage to such sensor and/or actuator.

According to a further aspect of the disclosure, there is provided an underground development drill comprising a drilling arm and having:

- a front limit sensor and front sensor actuator each configured for operative mounting at opposite ends of a forward drill feeder length of the arm;

a rear limit sensor and rear sensor actuator each configured for operative mounting at opposite ends of a return drill feeder length of the arm;

wherein each limit sensor comprises a proximity sensor with a wireless transmitter for transmitting a limit signal upon activation of the sensor;

wherein each sensor actuator is configured for actuating the respective proximity sensor when brought into proximity with the sensor; and a wireless receiver for receiving the limit signal and configured to interface with an existing control system of the drill, receipt of the limit signal causing the control system to feed or return the drilling arm automatically.

In an embodiment, a limit sensor and/or actuator includes an adjustable mount for mounting the sensor and/or actuator to the drilling arm so that the forward and/or return drill feeder lengths are adjustable.

In an embodiment, the limit sensor and/or actuator is adjustable so that the proximity of a sensor and actuator that actuates the sensor is adjustable.

In an embodiment, the limit sensor and/or actuator is configured to provide graded proximity activation, wherein the transmitted limit signal is indicative of at least two grades of proximity.

In an embodiment, the control system is configured to feed or return the drilling arm according to the at least two grades of proximity.

Typically, a limit sensor and/or actuator is encased in a ruggedized housing to prevent damage to such sensor and/or actuator.

According to a yet further aspect of the disclosure, there is provided a retrofittable return system for an underground development drill, the system comprising:

a front limit sensor and front sensor actuator each configured for operative mounting at opposite ends of a forward drill feeder length of a drilling arm of the drill;

a rear limit sensor and rear sensor actuator each configured for operative mounting at opposite ends of a return drill feeder length of the drilling arm;

wherein each limit sensor comprises a proximity sensor with a wireless transmitter for transmitting a limit signal upon activation of the sensor;

wherein each sensor actuator is configured for actuating the respective proximity sensor when brought into proximity with the sensor; and a wireless receiver for receiving the limit signal and configured to interface with an existing control system of the drill, receipt of the limit signal causing the control system to feed or return the drilling arm automatically.

In an embodiment, the limit sensor and/or actuator is configured to provide graded proximity activation, wherein the transmitted limit signal is indicative of at least two grades of proximity.

In an embodiment, the control system is configured to feed or return the drilling arm according to the at least two grades of proximity.

According to a further aspect of the disclosure, there is provided an underground development drill return system and an underground development drill having such a return system, substantially as herein described and/or illustrated.

BRIEF DESCRIPTION OF THE DRAWINGS

The description will be made with reference to the accompanying drawings in which.

DETAILED DESCRIPTION

Figure 1:
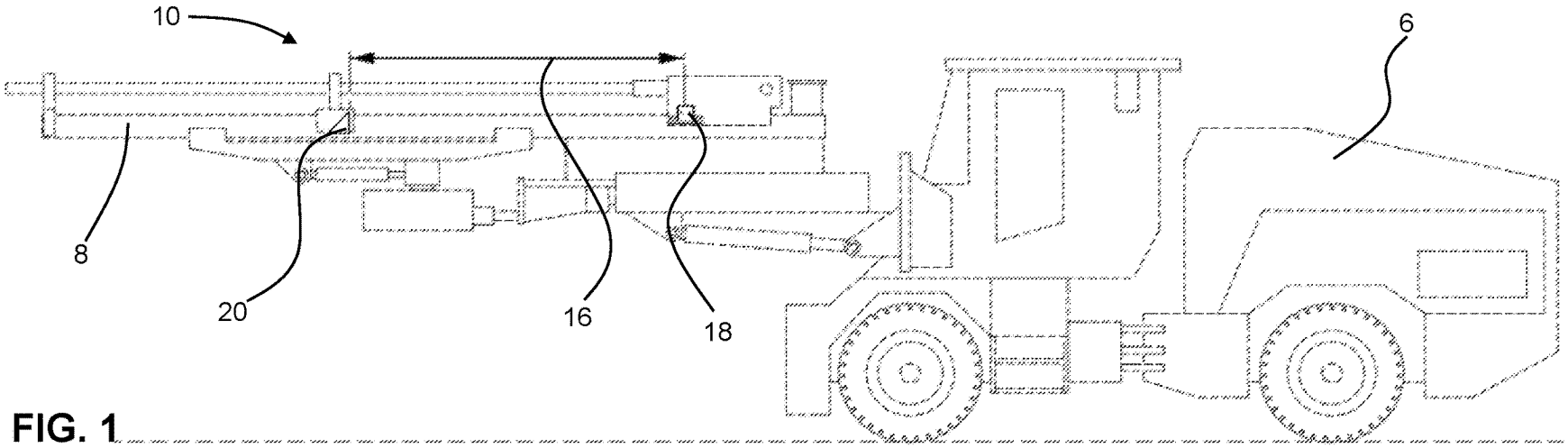
FIG. 1 is a diagrammatic left-side view representation of an example of an underground development drill having a drill return system in accordance with an aspect of the present disclosure.
Figure 2:
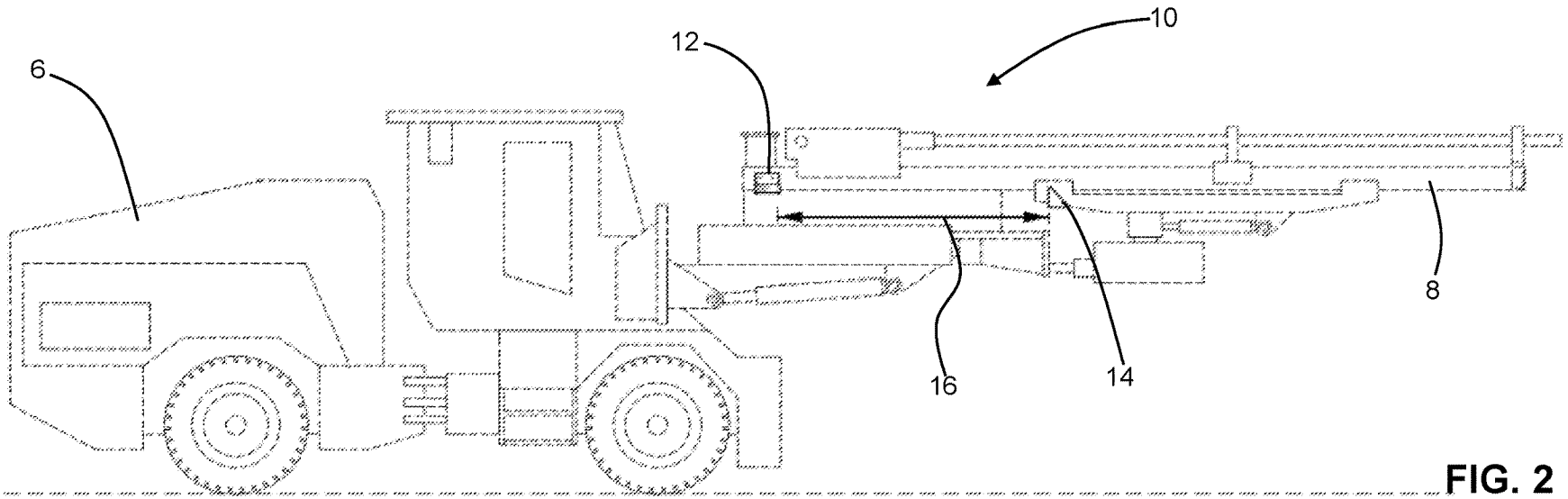
FIG. 2 is a diagrammatic right-side view representation of the underground development drill of FIG. 1.
Figure 3:
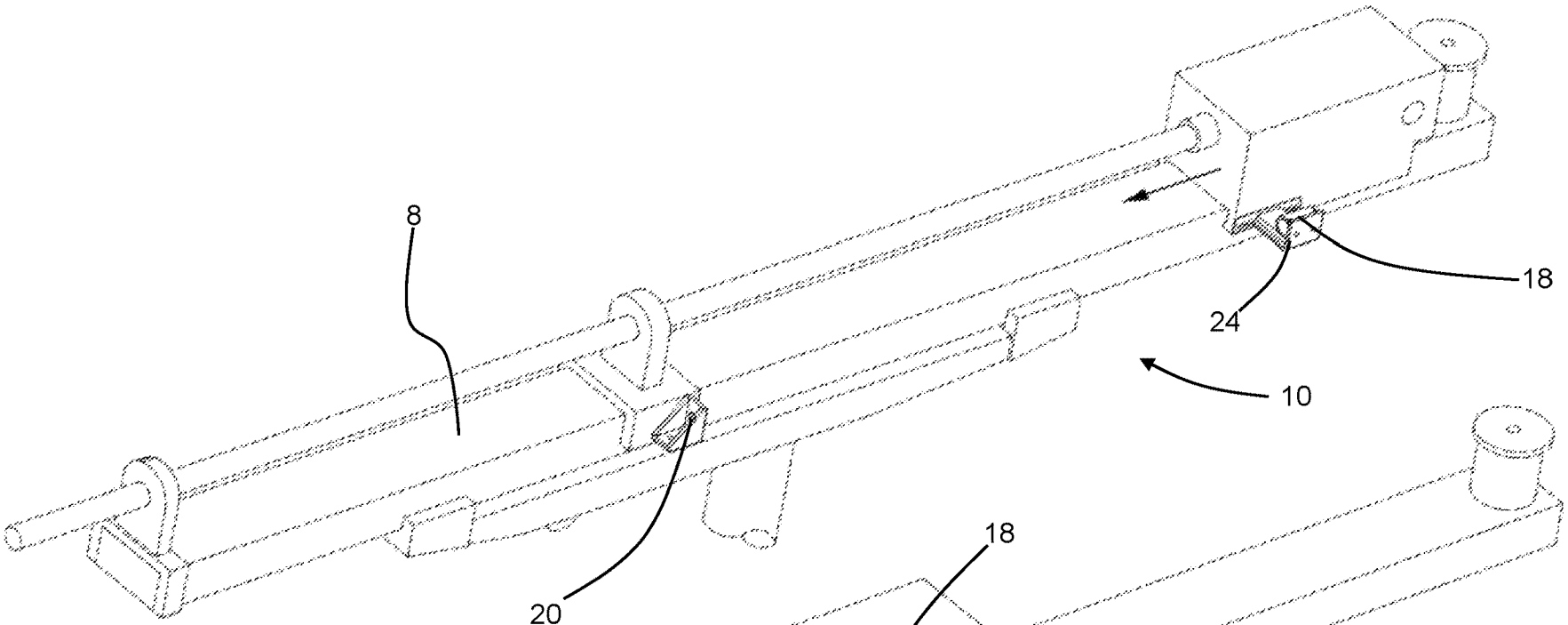
FIG. 3 is diagrammatic perspective left-side view representation of a drilling arm of the drill of FIG. 1, showing parts of the drill return system.
Figure 4:
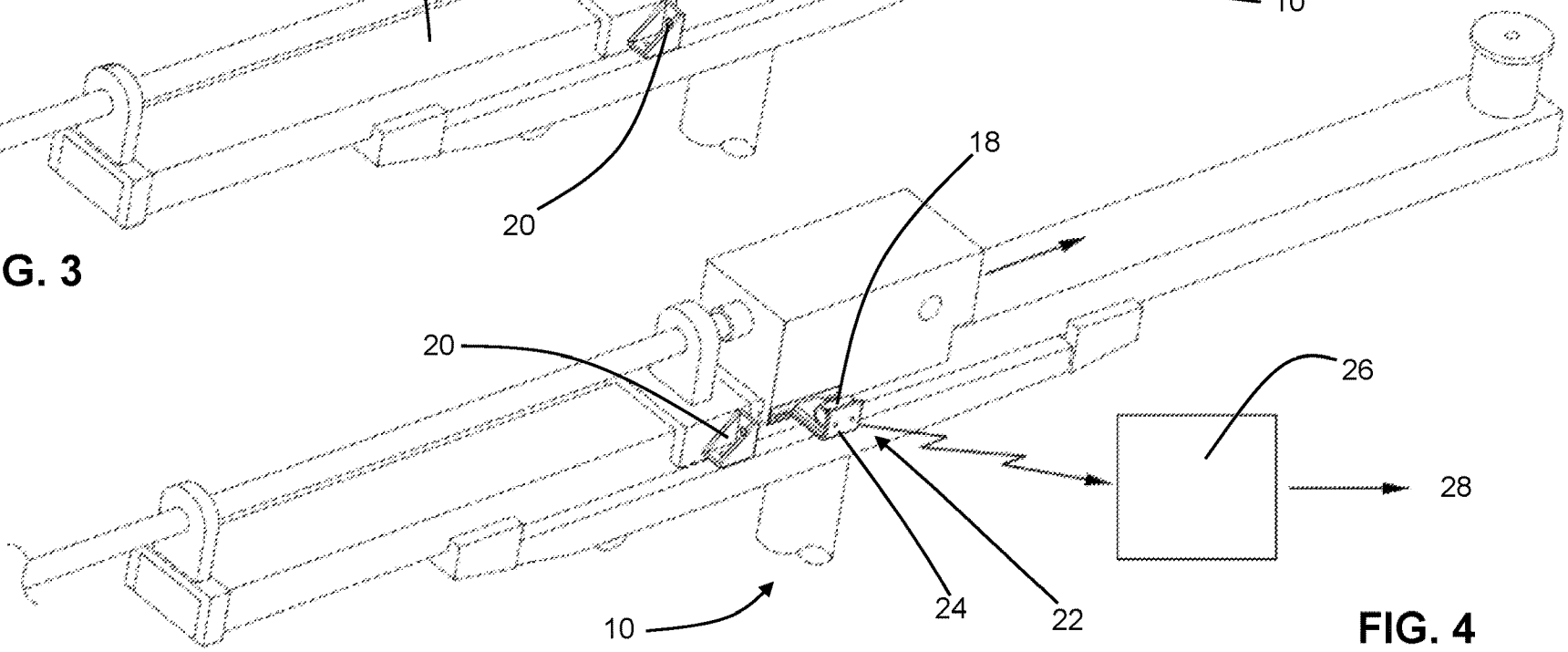
FIG. 4 is a diagrammatic perspective-view representation of the drilling arm of FIG. 3 at an end of a forward drill feed length thereof.
Figure 5:
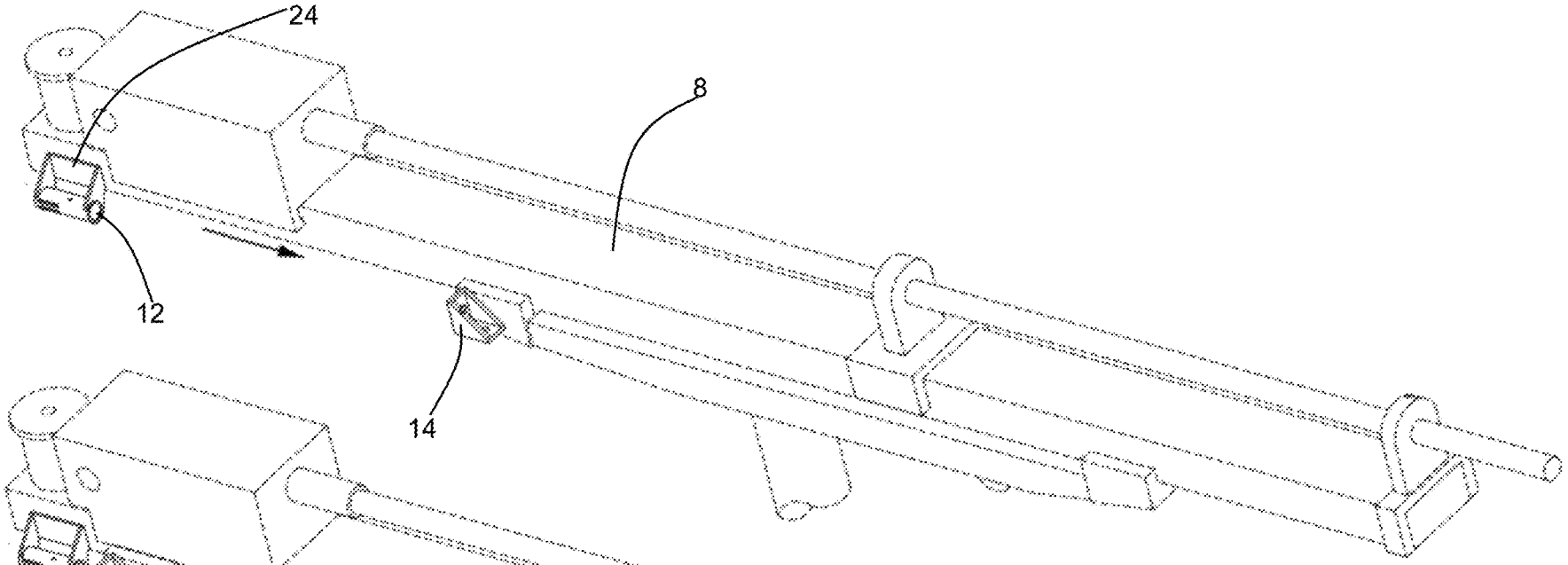
FIG. 5 is a diagrammatic perspective right-side view representation of the drilling arm of the drill of FIG. 1, showing parts of the drill return system.
Figure 6:
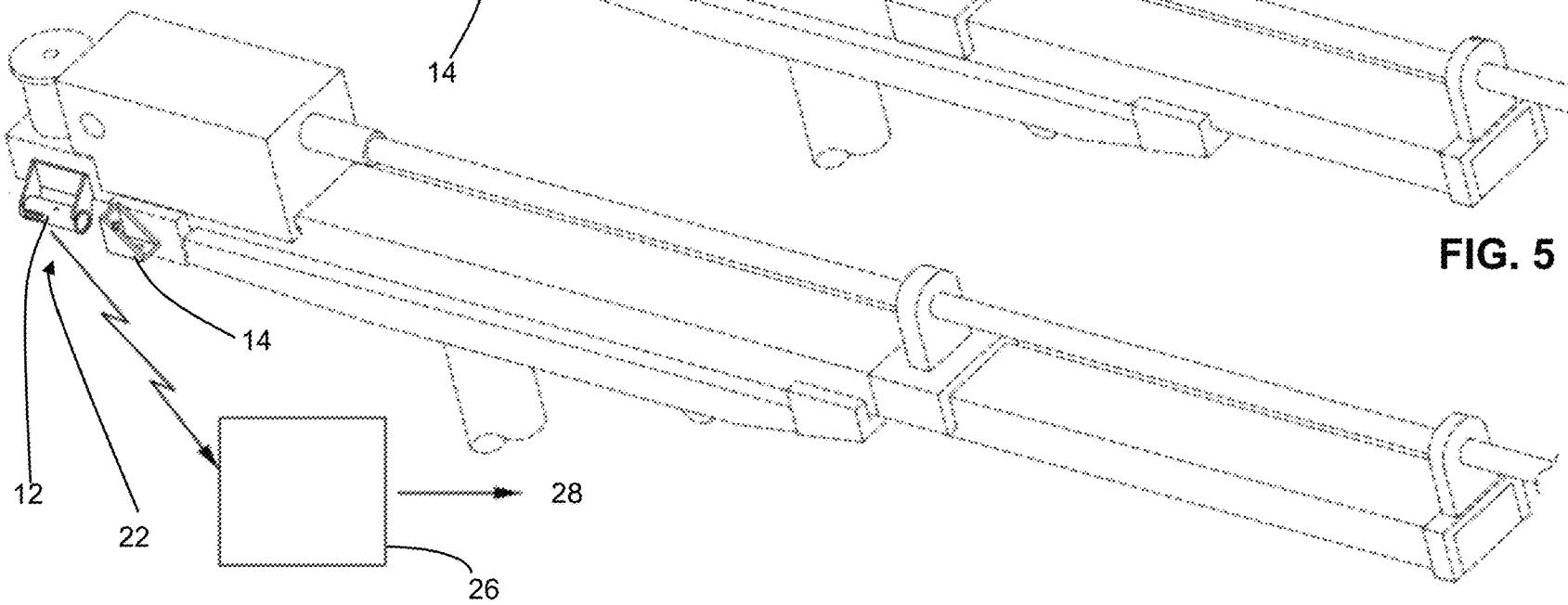
FIG. 6 is a diagrammatic perspective right-side view representation of the drilling arm of FIG. 5 at an end of a return or rearward drill feed length thereof.
Figure 9:
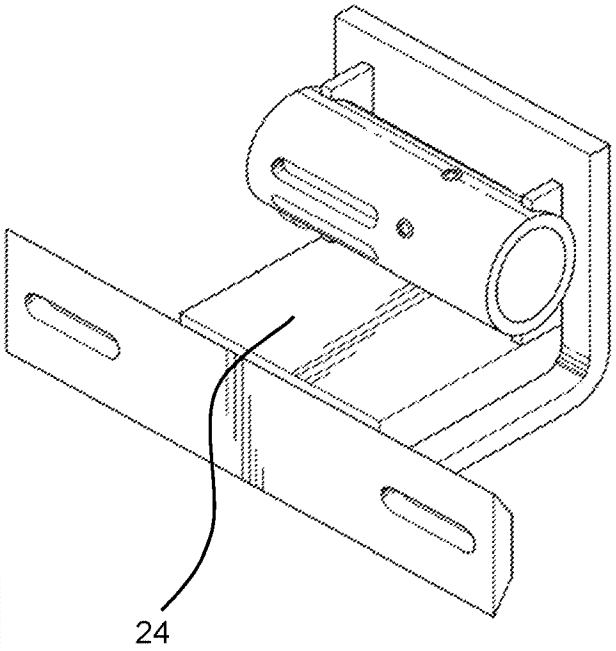
FIGS. 7 to 9 are diagrammatic perspective-view representations of different examples of adjustable mounts for the respective sensors and/or sensor actuators of the drill return system.
Figure 8:
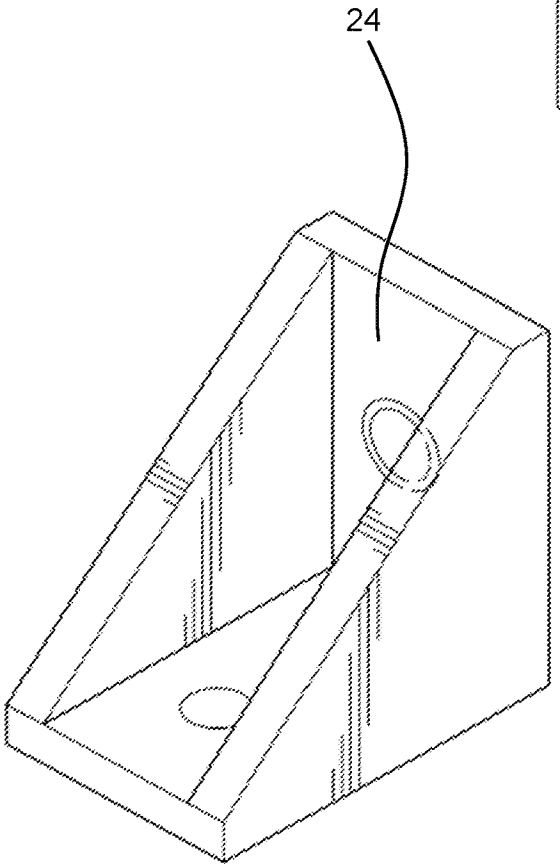
Figure 7:
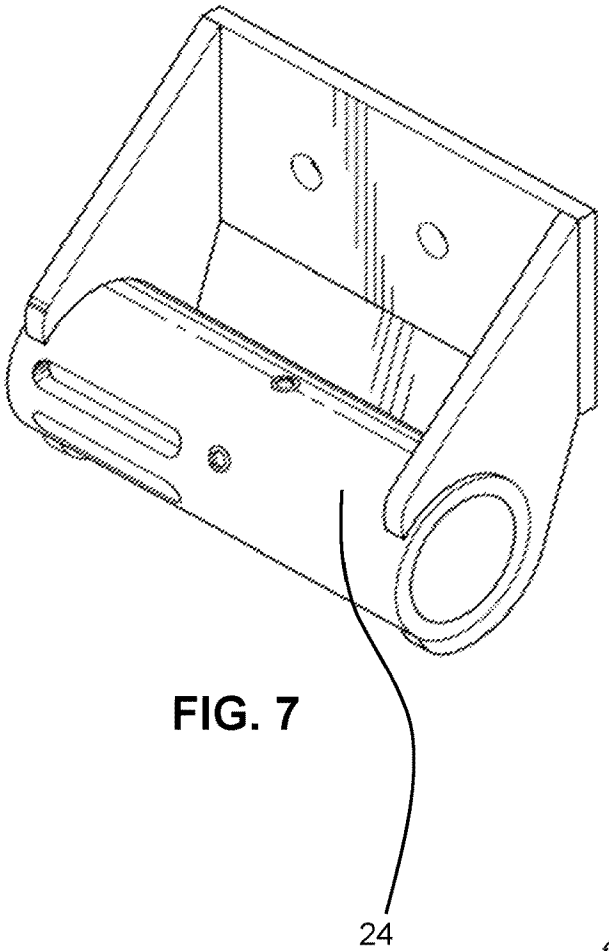

Further features of the present disclosure are more fully described in the following description of several non-limiting embodiments thereof. This description is included solely for the purposes of exemplifying the present disclosure to the skilled addressee. It should not be understood as a restriction on the broad summary, disclosure or description of the disclosure as set out above. In the figures, incorporated to illustrate features of the example embodiment or embodiments, like reference numerals are used to identify like parts throughout.

With reference now to the accompanying drawings, there is shown an embodiment of an underground development drill return system 10. Broadly, the system 10 comprises a front limit sensor 12 and front sensor actuator 14 each configured for operative mounting at opposite ends of a forward drill feeder length 16 of a drilling arm 8 of the drill 6, and a rear limit sensor 18 and rear sensor actuator 20 each configured for operative mounting at opposite ends of a return drill feeder length 16 of the drilling arm 8. Each limit sensor 12 and 18 comprises a proximity sensor with a wireless transmitter 22 for transmitting a limit signal upon activation of the sensor; and wherein each sensor actuator is configured for actuating the respective proximity sensor when brought into proximity with the sensor.

Such a system 10 is generally used on an underground development drill 6 having a drill feeder typically comprising a drilling arm 8 slidably arranged on an arm support, which is held stationary on a drill boom so that the drilling arm 8 slides forward when drilling and rearward when a drill bit is removed from a drilled hole, as is known in the art.

Accordingly, the drill return system 10 of the present disclosure generally comprises a front limit sensor 12 and front sensor actuator 14, which is each configured for operative mounting at opposite ends of a forward drill feeder length 16 of the drilling arm 8 of the drill 6.

Similarly, the system 10 includes a rear limit sensor 18 and rear sensor actuator 20, which is each configured for operative mounting at opposite ends of a return drill feeder length 16 of the drilling arm 8. Typically, the forward and return drill feeder lengths are the same.

Each limit sensor 12 and 18 comprises a proximity sensor, such as a magnetic Reed switch with a wireless transmitter 22 for transmitting a limit signal upon activation of the respective sensor 12 and 28. In turn, each sensor actuator 14 and 20 comprises a magnetic actuator for actuating the respective sensor 12 and 18 when brought into proximity of the sensor, as is generally understood in the art. Typically, each limit sensor and actuator is encased in a ruggedized housing to prevent damage to such sensor and/or actuator, particularly given the environments the drill 6 are typically used in.

As such, the respective forward and rearward drill feeder lengths 16 of the drilling arm 8 are generally determined by a distance separation between the front limit sensor 12 and front sensor actuator 14 and rear limit sensor 18 and rear sensor actuator 20, respectively. The skilled addressee will further appreciate that a Reed switch includes any electrical switch operated by an applied magnetic field. However, variations hereon are possible and within the scope of the present disclosure.

Each limit sensor 12 and 18 and sensor actuator 14 and 20 generally includes an adjustable mount 24 for mounting the sensor and/or actuator to the drilling arm 8 so that the forward and/or return drill feeder lengths 16 are adjustable, i.e., mountable according to requirements. In other embodiments, each limit sensor and/or actuator may be adjustable so that the proximity of a sensor and actuator that actuates the sensor is adjustable, e.g., adjustable magnetic fields, etc.

In an embodiment, the system 10 includes a wireless receiver 26 for receiving the limit signal sent by a wireless transmitter 22 of a sensor 12 or 18 and which is configured to interface with an existing control system 28 of the drill 6. In general, receipt of the limit signal by the existing control system 28, via the wireless receiver 26, causes the control system 28 to feed or return the drilling arm 8 automatically.

In an embodiment, the limit sensor and/or actuator is configured to provide graded proximity activation, wherein the transmitted limit signal is indicative of at least two grades of proximity. In an embodiment, the control system 28 is configured to feed or return the drilling arm 8 according to the at least two grades of proximity. For example, the control system 28 may be configured to drill and/or feed or return at different speeds according to the at least two grades of proximity. Similarly, the graded proximity detection may serve as a "soft-stop" or "soft-start" to the drill feeding process, where the system 10 can sense an extent of drill arm feed and control the drilling and/or feeding accordingly.

For example, a drill speed can be reduced when a drill nears a final drill depth, or a drill can be started at a slower (or faster) speed when drilling is about to commence, requirements depending. Similarly, feeding of the drilling arm 8 can be controlled to minimize jerky or erratic movements, thereby extending equipment lifespan, or the like.

Applicant believes is particularly advantageous that the present disclosure provides for a retrofittable drill return system 10 whereby a drilling arm 8 of an underground development drill 6 can be automatically returned or cycled between drilling holes. Such a drill return system 10 makes use of wireless technology, which alleviates damage to hydraulic hoses relied on by conventional hydraulic return systems. In addition, the system 10 allows graded proximity detection, which allows graded drill control that generally leads to less wear and tear on the drill resulting from sudden stops and starts, or the like.

Optional embodiments of the present disclosure may also be said to broadly consist in the parts, elements and features referred to or indicated herein, individually or collectively, in any or all combinations of two or more of the parts, elements or features, and wherein specific integers are mentioned herein that have known equivalents in the art to which the disclosure relates, such known equivalents are deemed to be incorporated herein as if individually set forth. In the example embodiments, well-known processes, well-known device structures, and well-known technologies are not described in detail, as such will be readily understood by the skilled addressee.

The use of the terms "a," "an," "said," "the," and/or similar referents in the context of describing various embodiments (especially in the context of the claimed subject matter) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. As used herein, the term "and/or" includes any and all combinations of one or more of the associated listed items. No language in the specification should be construed as indicating any non-claimed subject matter as essential to the practice of the claimed subject matter.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Accordingly, one example may exemplify certain aspects of the disclosure, while other aspects are exemplified in a different example. These examples are intended to assist the skilled person in performing the disclosure and are not intended to limit the overall scope of the disclosure in any way unless the context clearly indicates otherwise. Variations, such as modifications and/or enhancements, of one or more embodiments described herein might become apparent to those of ordinary skill in the art upon reading this application. The inventor(s) expects skilled artisans to employ such variations as appropriate, and the inventor(s) intends for the claimed subject matter to be practiced other than as specifically described herein.

The invention claimed is:

1. An underground development drill return system comprising:

a front limit sensor and front sensor actuator each configured for operative mounting at opposite ends of a forward drill feeder length of a drilling arm of the drill return system; and a rear limit sensor and rear sensor actuator each configured for operative mounting at opposite ends of a return drill feeder length of the drilling arm;

wherein each of the front limit sensor and the rear limit sensor comprises a proximity sensor with a wireless transmitter for transmitting a limit signal upon activation of the proximity sensor;

wherein each of the front sensor actuator and the rear sensor actuator is configured for actuating the proximity sensor operatively associated therewith when brought into proximity with the proximity sensor; and wherein one or more of the front limit sensor, the front sensor actuator, the rear limit sensor, and the rear sensor actuator is adjustable so that the proximity of the one or more of the front limit sensor, the front sensor actuator, the rear limit sensor, and the rear sensor actuator for actuation of one or more of the front limit sensor and the rear limit sensor is adjustable.

2. The drill return system of claim 1, wherein one or more of the front limit sensor, the front sensor actuator, the rear limit sensor, and the rear sensor actuator includes an adjustable mount for mounting the one or more of the front limit sensor, the front sensor actuator, the rear limit sensor, and the rear sensor actuator to the drilling arm so that one or more of the forward drill feeder length and the return drill feeder length are adjustable.

3. The drill return system of claim 1, wherein one or more of the front limit sensor, the front sensor actuator, the rear limit sensor, and the rear sensor actuator is configured to provide graded proximity activation, wherein the transmitted limit signal is indicative of at least two grades of proximity.

4. The drill return system of claim 1, wherein the proximity sensor comprises a magnetic Reed switch and each of the front sensor actuator and the rear sensor actuator comprises a magnetic actuator.

5. The drill return system of claim 1, further comprising a wireless receiver for receiving the limit signal and configured to interface with an existing control system of the drill return system, receipt of the limit signal causing the control system to feed or return the drilling arm automatically.

6. The drill return system of claim 5, wherein the control system is configured to feed or return the drilling arm according to at least two grades of proximity.

7. An underground development drill having a drilling arm, the underground development drill comprising:

a front limit sensor and front sensor actuator each configured for operative mounting at opposite ends of a forward drill feeder length of the drilling arm;

a rear limit sensor and rear sensor actuator each configured for operative mounting at opposite ends of a return drill feeder length of the drilling arm;

wherein each of the front limit sensor and the rear limit sensor comprises a proximity sensor with a wireless transmitter for transmitting a limit signal upon activation of the proximity sensor;

wherein each of the front sensor actuator and the rear sensor actuator is configured for actuating the proximity sensor operatively associated therewith when brought into proximity with the proximity sensor;

a wireless receiver for receiving the limit signal and configured to interface with an existing control system of the underground development drill, receipt of the limit signal causing the control system to feed or return the drilling arm automatically; and wherein one or more of the front limit sensor, the front sensor actuator, the rear limit sensor, and the rear sensor actuator is adjustable so that the proximity of the one or more of the front limit sensor, the front sensor actuator, the rear limit sensor, and the rear sensor actuator for actuation of one or more of the front limit sensor and the rear limit sensor is adjustable.

8. The underground development drill of claim 7, wherein one or more of the front limit sensor, the front sensor actuator, the rear limit sensor, and the rear sensor actuator includes an adjustable mount for mounting the one or more of the front limit sensor, the front sensor actuator, the rear limit sensor, and the rear sensor actuator to the drilling arm so that one or more of the forward drill feeder length and the return drill feeder length are adjustable.

9. The underground development drill of claim 7, wherein one or more of the front limit sensor, the front sensor actuator, the rear limit sensor, and the rear sensor actuator is configured to provide graded proximity activation, wherein the transmitted limit signal is indicative of at least two grades of proximity.

10. The underground development drill of claim 9, wherein the control system is configured to feed or return the drilling arm according to the at least two grades of proximity.

11. The underground development drill of claim 7, wherein one or more of the front limit sensor, the front sensor actuator, the rear limit sensor, and the rear sensor actuator is encased in a ruggedized housing to prevent damage to the one or more of the front limit sensor, the front sensor actuator, the rear limit sensor, and the rear sensor actuator.

12. A retrofittable return system for an underground development drill, the retrofittable return system comprising:

a front limit sensor and front sensor actuator each configured for operative mounting at opposite ends of a forward drill feeder length of a drilling arm of the underground development drill;

a rear limit sensor and rear sensor actuator each configured for operative mounting at opposite ends of a return drill feeder length of the drilling arm;

wherein each of the front limit sensor and the rear limit sensor comprises a proximity sensor with a wireless transmitter for transmitting a limit signal upon activation of the proximity sensor;

wherein each of the front sensor actuator and the rear sensor actuator is configured for actuating the proximity sensor operatively associated therewith when brought into proximity with the proximity sensor; and wherein one or more of the front limit sensor, the front sensor actuator, the rear limit sensor, and the rear sensor actuator is adjustable so that the proximity of the one or more of the front limit sensor, the front sensor actuator, the rear limit sensor, and the rear sensor actuator for actuation of one or more of the front limit sensor and the rear limit sensor is adjustable; and a wireless receiver for receiving the limit signal and configured to interface with an existing control system of the underground development drill, receipt of the limit signal causing the control system to feed or return the drilling arm automatically.

13. The retrofittable return system of claim 12, wherein one or more of the front limit sensor, the front sensor actuator, the rear limit sensor, and the rear sensor actuator is configured to provide graded proximity activation, wherein the transmitted limit signal is indicative of at least two grades of proximity.

14. The retrofittable return system of claim 13, wherein the control system is configured to feed or return the drilling arm according to the at least two grades of proximity.

15. The retrofittable return system of claim 14, wherein the control system is configured for one or more of drilling, feeding, and returning at different speeds according to the at least two grades of proximity.

* * * * *